United States Patent [19]

Bigelow

[11] 4,067,740

[45] Jan. 10, 1978

[54] TRITHIOCARBONATES AS SENSITIZERS FOR SILVER HALIDE EMULSIONS

[75] Inventor: John Howard Bigelow, Rochester, N.Y.

[73] Assignee: E. I. Du Pont de Nemours and Company, Wilmington, Del.

[21] Appl. No.: 752,914

[22] Filed: Dec. 21, 1976

[51] Int. Cl.[2] ..... G03C 1/28

[52] U.S. Cl. ..... 96/107

[58] Field of Search ..... 96/107, 109

[56] References Cited

U.S. PATENT DOCUMENTS 1,678,832 7/1968 Sheppard ..... 96/107

OTHER PUBLICATIONS

J. Org. Chem. 26 pp. 4047–4051 (1961).

*Primary Examiner*—Won H. Louie, Jr.

[57] ABSTRACT

Photographic colloid-silver halide emulsions are chemically sensitized by the addition prior to or during digestion of at least one trithiocarbonate compound of the general formula:

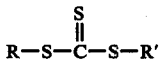

wherein R is a tertiary alkyl radical having from 4 to 16 carbon atoms and R′ may be the same as R or an aryl or an alphyl radical containing 1 to 3 aryl groups which may be substituted or unsubstituted.

7 Claims, No Drawings

TRITHIOCARBONATES AS SENSITIZERS FOR SILVER HALIDE EMULSIONS

BACKGROUND OF THE INVENTION

The chemical sensitization of colloid-silver halide photographic emulsions by a variety of compounds used either alone or in combination has been well documented as shown in Mees-James, "The Theory of The Photographic Process", 1966, the Macmillan Company, Chapter 3 and Chapter 5. Perhaps the oldest and most commonly used method of sensitization is by the addition to a photographic emulsion of a compound which will provide labile sulfur to the silver halide system. It is with this type of sensitization that the present invention is primarily concerned.

SUMMARY OF THE INVENTION

It has been discovered that certain trithiocarbonates will chemically sensitize silver halide photographic emulsions when they are added either prior to or during the digestion stage of the emulsion-making process; specifically a compound of the general formula:

$$R-S-\overset{\overset{\displaystyle S}{\|}}{C}-S-R'$$

wherein R is a $C_4$–$C_{16}$ tertiary alkyl radical e.g. t-butyl, 1,1-dimethyl propyl, 1-methyl-1-ethyl propyl, 1,1-diethyl propyl, t-pentyl, t-hexyl, etc. R′ is selected from the group designated for R and may be the same or different from the R radical or it may be an aryl or alphyl group such as a mono-, di- or triphenyl methyl radical.

DETAILED DESCRIPTION

The trithiocarbonates of the invention have been found to be particularly efficacious chemical sensitizers for fast negative type emulsions; however, they may also be used in other silver halide emulsions such as those used in graphic arts, e.g., lithographic materials, those used in radiographic work, e.g., x-ray films, color films, photographic films used for diffusion transfer processes, etc., and may comprise silver chloride, bromide, iodobromide, chlorobromide, iodochlorobromide, etc.

The photographic elements of this invention are particularly useful in the graphic arts field, i.e., lithographic films, direct positive films and photographic elements for microfilms. Addition of the trithiocarbonate compounds of this invention to the photographic silver halide emulsions improves maximum density, speed and contrast.

The trithiocarbonate compounds may be added at any stage of the preparation of the silver halide emulsions prior to end of the digestion stage, e.g., during precipitation of the silver halides, during ripening, after the washing and redispersion stage, or during digestion. They may conveniently be added during emulsion preparation from any common organic solvent such as ethyl alcohol, acetone, etc., or mixtures thereof.

Among the trithiocarbonate compounds suitable for use in the present invention, the following are illustrative:

1. Tert.-butyl triphenyl methyl-trithiocarbonate

-continued $$(CH_3)_3C-S-\overset{\overset{\displaystyle S}{\|}}{C}-S-C\phi_3$$

2. Di-tert.-butyl trithiocarbonate $$(CH_3)_3C-S-\overset{\overset{\displaystyle S}{\|}}{C}-S-C(CH_3)_3$$

3. 1,1-Dimethyl propyl triphenyl methyl trithiocarbonate $$CH_3CH_2\underset{\underset{\displaystyle CH_3}{|}}{\overset{\overset{\displaystyle CH_3}{|}}{C}}-S-\overset{\overset{\displaystyle S}{\|}}{C}-S-C\phi_3$$

4. Tert.-butyl diphenyl methyl trithiocarbonate $$(CH_3)_3C-S-\overset{\overset{\displaystyle S}{\|}}{C}-S-CH\phi_2$$

5. Tert.-butyl phenyl methyl trithiocarbonate $$(CH_3)_3C-S-\overset{\overset{\displaystyle S}{\|}}{C}-S-CH_2\phi$$

6. Tert.-butyl phenyl trithiocarbonate $$(CH_3)_3C-S-\overset{\overset{\displaystyle S}{\|}}{C}-S-\phi$$

The trithiocarbonate compounds may be synthesized according to the procedures set forth in J. Org. Chem. 26 4047 (1961).

As indicated above, the trithiocarbonate may be added to a variety of silver halide emulsions, and those emulsions may contain optical sensitizing dyes, antifoggants and other chemical sensitizers including conventional sulfur, noble metal and reduction type sensitizers. The optimum quantity of trithiocarbonate compound will, of course, depend upon the particular type of emulsion and the desired effect and can vary within wide limits. The optimum amount to be added can be determined for each emulsion by simple experiment as is customary in the art of emulsion manufacture. Generally, the most suitable concentration will be found to be from $1.0 \times 10^{-5}$ to $7 \times 10^{-4}$ mole per 1.5 moles of silver halide in the emulsion. The emulsions may be coated on any suitable support including a sheet support such as photographic quality paper and film. For example, cellulose supports, e.g., cellulose acetate, cellulose triacetate, cellulose mixed esters, etc., may be used. Polymerized vinyl compound, e.g., copolymerized vinyl acetate and vinyl chloride, polystyrene and polymerized acrylates may also be mentioned. The film formed from polyesters made according to the teachings of U.S. Pat. No. 2,779,684 and the patents referred to in the specification of that patent may be used. Other suitable supports are the polyethylene terephthalate/isophthalates of British Pat. No. 766,290 and Canadian Pat. No. 562,672 and those obtainable by condensing terephthalic acid and dimethylterephthalate with propylene glycol, diethylene glycol, tetramethylene glycol or cyclohexane-1,4-dimethanol (hexahydro-p-xylene alcohol). The films of U.S. Pat. No. 3,052,543 may also be used.

The following procedures and examples will serve to illustrate the invention in a more detailed manner. In these examples the trithiocarbonate compounds were added to silver halide emulsions during the precipitation of the silver halides, just prior to or during the digestion period.

Silver halide emulsions were prepared according to the following procedures:

Procedure A

Silver Chlorobromide Emulsion

A gelatino-silver chlorobromide emulsion was made by rapidly adding to an acidified gelatin solution containing 1.5 moles of potassium chloride, 1.5 moles of silver nitrate in aqueous solution. There was then added 0.6 mole of potassium bromide in aqueous solution and the mixture was allowed to ripen for 10 minutes, after which 0.9 moles of potassium bromide in aqueous solution was added and the emulsion was allowed to ripen an additional 10 minutes all at 160° F. The emulsion was cooled, coagulated, washed and redispersed in the manner disclosed in Moede, U.S. Pat. No. 2,772,165.

Procedure B

Silver Iodobromide Emulsion

A gelatino-silver iodobromide emulsion containing 1.6 mole percent silver iodide was made by rapidly pouring an aqueous solution containing 1.5 moles of silver nitrate and 3.0 moles of ammonia into an aqueous gelatin solution containing 1.5 moles of potassium bromide and the required amount of potassium iodide. The resulting emulsion was ripened for 5 minutes at 135° F., and then the ammonia was neutralized with acetic acid. The emulsion was cooled, coagulated, washed and redispersed in the manner disclosed in Moede, U.S. Pat. No. 2,772,165.

Procedure C

Monodispersed Silver Iodobromide Emulsion

A silver iodobromide emulsion containing 1.0 mole percent iodide was prepared by a balanced double jet method in which aqueous solutions of silver nitrate and alkali metal iodobromide salts were added to an aqueous ammoniacal gelatin solution at a temperature of 115° F. in the presence of insufficient ammonia to convert the silver completely and at a constant pAg of 8.35 to produce a 0.2 micron average grain size. The emulsion was freed from soluble salts by washing in the manner referred to in Procedure A above.

Procedure D

Silver Chlorobromide Emulsion Containing Plumbous Ion

A gelatino-silver chlorobromide emulsion was made by rapidly adding to an acidified gelatin solution containing 1.5 moles of ammonium chloride and 0.2 mole percent of plumbous nitrate, 1.5 moles of silver nitrate at a temperature of 154° F. There was then added 0.6 mole of aqueous potassium bromide solution and the mixture allowed to ripen for 10 minutes, after which there was added 0.9 mole of aqueous potassium bromide solution and the mixture allowed to ripen for 10 minutes. The resulting emulsion was freed of unwanted soluble salts as described in the above procedures.

Procedure E

Silver Iodobromide Emulsion Containing Cadmium Ion

A gelatino-silver iodobromide emulsion containing 1.27% iodide and 0.25% cadmium ion was made by adding aqueous silver nitrate solution in two equal portions to an aqueous gelatin solution containing the required amount of potassium iodide and bromide and cadmium bromide. The precipitation was carried out at 118° F. After the first silver nitrate addition the emulsion was ripened 14 minutes and after the second addition it was ripened for 7 minutes in the presence of sufficient ammonia to convert only 13% of the silver present and the ammonia was then neutralized with sulfuric acid. The emulsion was then freed of unwanted soluble salts as described above.

Procedure F

Unsensitized Negative Type Emulsion Remelt Digestion

To a silver halide emulsion containing the equivalent of 1.5 moles of silver nitrate and made by Procedures A or B above there was added bulking gelatin and the temperature was raised to 130° F. The pH was adjusted to 8 with borax and the mixture was digested for 40 minutes at 130° F. The pH was adjusted to 5.5, coating aids and gelatin hardeners were added and the emulsions were coated on a photographic quality film base and dried in a conventional manner.

Procedure G

Sensitized Negative Type Emulsion Digestion

To a silver halide emulsion containing the equivalent of 1.5 moles of silver nitrate and made by Procedures A through E above there was added bulking gelatin and the temperature was raised to 110° F. The pH was adjusted to 6.5. The emulsion was heated to 125° F., and there was added $3.3 \times 10^{-6}$ mole of gold sensitizer in the form of gold chloride, and $1.74 \times 10^{-5}$ mole of the sulfur sensitizer, sodium thiosulfate. After the addition of sensitizers, the emulsion pH was about 7. The emulsion was then digested for 60 minutes at 125° F. The pH was then adjusted to 5.5; coating aids and a gelatin hardener were added; and the emulsions were coated on a photographic quality film support and dried in a conventional manner.

Procedure H

Optically Sensitized Negative Type Emulsion Digestion

To a silver halide emulsion containing the equivalent of 1.5 moles of silver nitrate and made according to Procedure E above there was added bulking gelatin and the temperature was raised to 110° F. The pH was adjusted as listed in Table VII and $5.28 \times 10^{-6}$ moles of gold ($Au^{+++}$) as a soluble salt together with $3.81 \times 10^{-3}$ of thiocyanate ($CNS^-$) ion. Sulfur - donor sensitizers were added as indicated in Example 7. The emulsions were digested for 2 hours at 125° F. The pH was adjusted to 5.5. The emulsions were optically sensitized with optical sensitizing dyes of the type disclosed in U.S. Pat. No. 2,493,748. Coating aids and gelatin hardeners were added and the resulting emulsions were coated on a film support and dried in a conventional manner.

EXAMPLE 1

Two silver chlorobromide emulsions were made according to Procedure A above. One emulsion was used as a control and the other contained $4.9 \times 10^{-4}$ moles of Compound 1 listed above per 1.5 moles of silver nitrate, said compound having been added in the aqueous gelatin halide salt solution before the silver halide precipitation. The resulting emulsions were digested according to Procedure F above and coated.

The coatings were cut into sensitometric strips and exposed in a sensitometer through a $\sqrt{2}$ step wedge by means of a quartz-iodine lamp which provided an exposure of 514,000 meter-candle seconds. The strips were processed for 1½ minutes at 80° F. in a high contrast, hydroquinone-formaldehyde-bisulfite developer. The sensitometric results are shown in the following table.

Table I

| Coating No. | Additive | Dmin. | Dmax. |
|---|---|---|---|
| 1 | None - Control | .05 | .04 |
| 2 | $4.9 \times 10^{-4}$ mole of Compd. 1/1.5 moles Ag $NO_3$ | .07 | 2.46 |

EXAMPLE 2

A silver chlorobromide emulsion was made as described in Procedure A and digested according to Procedure G except that Compound 1 above was used in place of the sodium thiosulfate ($S_2O_3^{=}$) as the sulfur sensitizer as indicated in the following table. Sensitometric strips were exposed in a sensitometer through a $\sqrt{2}$ step wedge using a source equivalent to 4470 meter-candle-seconds and developed for 22 seconds at 100° F. in a conventional metolhydroquinone developer and fixed, washed and dried. Sensitometric results are shown in the following table. The strips were tested fresh and after being aged for 7 days in an oven at 120° F. and 65% relative humidity. The trithiocarbonate gives a greater response than thiosulfate.

Table II

| Ctg. No. | Compd. Added | Test Age | Dmin | Dmax | Density Step #2 |
|---|---|---|---|---|---|
| 1 | $1.74 \times 10^{-5}$ mole $Na_2S_2O_3$/1.5 moles $AgNO_3$ Control | Fresh | .03 | .98 | .08 |
| | | Oven | .04 | .70 | .09 |
| 2 | $3.4 \times 10^{-4}$ mole of Compd. 1/ 1.5 moles $AgNO_3$ | Fresh | .09 | 2.71 | .86 |
| | | Oven | .08 | 2.92 | 1.09 |

EXAMPLE 3

A silver chlorobromide emulsion containing plumbous ion was made according to Procedure D and digested as described in Procedure G except that the compounds identified in the following table were used in place of sodium thiosulfate as the sulfur sensitizer, the sodium thiosulfate being used as the control ans designated as ($S_2O_3^{=}$). All compounds were used in amounts of $1.7 \times 10^{-4}$ mole per 1.5 moles of silver nitrate except the thiosulfate which was used in an amount of $1.7 \times 10^{-5}$. The sensitometric strips were exposed and processed in the manner set forth in Example 2. The results are shown in the following table. All trithiocarbonates show improved speeds over thiosulfate.

Table III

| Ctg. No. | Additive | Test Age | Dmin | Dmax | Dens. Step 2 | Speed/fog = Dens. Step 2/Dmin |
|---|---|---|---|---|---|---|
| 1 | Control - ($S_2O_3^{=2}$) | Fresh | .03 | 1.01 | .11 | 3.7 |
| | | Oven | .03 | .86 | .08 | 2.6 |
| 2 | Comp. 1 | Fresh | .13 | 2.82 | 1.09 | 8.4 |
| | | Oven | .13 | 2.61 | 1.22 | 9.4 |
| 3 | Comp. 2 | Fresh | .06 | 3.05 | .65 | 10.8 |
| | | Oven | .03 | 2.97 | .69 | 23.0 |
| 4 | Comp. 3 | Fresh | .20 | 2.80 | 1.07 | 5.4 |
| | | Oven | .29 | 2.63 | 1.15 | 4.0 |
| 5 | Comp. 4 | Fresh | .08 | 3.69 | 1.28 | 16.0 |

Table III-continued

| Ctg. No. | Additive | Test Age | Dmin | Dmax | Dens. Step 2 | Speed/fog = Dens. Step 2/Dmin |
|---|---|---|---|---|---|---|
| | | Oven | .08 | 3.68 | 1.49 | 18.2 |

EXAMPLE 4

A silver iodobromide emulsion was made according to Procedure B and digested as in Procedure G to compare the effect of sodium thiosulfate as a sulfur sensitizer with Compound 1 above and in admixture therewith. The sodium thiosulfate was used in amounts of $1.74 \times 10^{-5}$ mole per 1.5 moles of silver nitrate when used alone and in admixture with Compound 1 and Compound 1 was used in amounts of $3.4 \times 10^{-4}$ mole per 1.5 moles of silver nitrate in both cases. The sensitometric strips were exposed and processed as described in Example 2 and gave the results shown in the following table. The trithiocarbonate shows improved response in the presence or absence of thiosulfate.

Table IV

| Coating No. | Additive | Test Age | Dmin | Dmax | Dens. Step 2 |
|---|---|---|---|---|---|
| 1 | $Na_2S_2O_3$ | Fresh | .04 | 2.85 | .07 |
| | | Oven | .03 | 2.49 | .08 |
| 2 | Compound 1 | Fresh | .09 | 3.17 | 1.33 |
| | | Oven | .06 | 2.73 | .99 |
| 3 | $Na_2S_2O_3$ + Compound 1 | Fresh | .10 | 3.56 | 1.42 |
| | | Oven | .08 | 3.23 | 1.17 |

EXAMPLE 5

A silver iodobromide emulsion was made according to Procedure C and digested according to Procedure G to compare the sulfur sensitizer, sodium thiosulfate with Compound 1 when added in equal molar quantities ($8.7 \times 10^{-5}$ mole per 1.5 moles of silver nitrate) during digestion. The sensitometric strips were exposed and processed as described in Example 2. The results are shown in the table below. The trithiocarbonate gives better response than thiosulfate.

Table V

| Coating No. | Additive | Dmin. | Dmax. | Speed (Dens. = 1.0) |
|---|---|---|---|---|
| 1 | $Na_2S_2O_3$ | .04 | 3.56 | 100 |
| 2 | Compound 1 | .04 | 4.72 | 137 |

EXAMPLE 6

Silver iodobromide emulsions were made as indicated in Example 5. One was sulfur sensitized with $1.74 \times 10^{-5}$ mole of sodium thiosulfate and four other emulsions were sensitized with $8.5 \times 10^{-5}$, $1.7 \times 10^{-4}$, $3.4 \times 10^{-4}$ and $6.8 \times 10^{-4}$ moles of Compound 1 in place of sodium thiosulfate all per 1.5 moles of silver nitrate. Sensitometric strips of the coated emulsions were exposed and processed as described in Example 2 and gave the results shown in the table below. Compound 1 maintains its advantage over thiosulfate over the whole concentration range.

Table VI

| Ctg. No. | Additive | Test Age | Dmin | Dmax | Speed (D = 1.0) |
|---|---|---|---|---|---|
| 1 | $Na_2S_2O_3$ | Fresh | .03 | 2.42 | 24 |
| | | Oven | .03 | 2.80 | 66 |
| 2 | $8.5 \times 10^{-5}$ | Fresh | .05 | 4.68 | 209 |

Table VI-continued

| Ctg. No. | Additive | Test Age | Dmin | Dmax | Speed (D = 1.0) |
|---|---|---|---|---|---|
| | Compound 1 | | | | |
| | | Oven | .04 | 4.45 | 182 |
| 3 | $1.7 \times 10^{-4}$ | Fresh | .05 | 5.11 | 317 |
| | | Oven | .05 | 5.01 | 321 |
| 4 | $3.4 \times 10^{-4}$ | Fresh | .06 | 5.53 | 367 |
| | | Oven | .05 | 5.20 | 383 |
| 5 | $6.8 \times 10^{-4}$ | Fresh | .06 | 5.62 | 316 |
| | | Oven | .06 | 5.49 | 285 |

EXAMPLE 7

Silver iodobromide emulsions were made according to Procedure E and remelted according to Procedure H. One emulsion was sulfur sensitized with $1.6 \times 10^{-5}$ mole of sodium thiosulfate per 1.5 moles of silver nitrate and another emulsion was sulfur sensitized with $1.6 \times 10^{-5}$ mole of Compound 4 per 1.5 moles of silver nitrate. Sensitometric strips from the coated emulsions were exposed for $10^{-4}$ seconds through a $\sqrt{2}$ step wedge on an Edgerton, Germeshausen and Greer flash tube Sensitometer Mark VII to provide an exposure of 130 meter-candle-seconds. The strips were processed in a Rolor automatic processor in a commercial hydroquinone-phenidone continuous tone developer for one minute at 80° F. (1X/3X fog samples are processed 1 minute and 3 minutes as above with no exposure). The sensitometric results are shown in the table below. The trithiocarbonate produces greater response with lower fog than thiosulfate.

Table VII

| Coating No. | Additive | Digestive pH | 1X/3X Fog | Dmax | Speed (D = 1.3) |
|---|---|---|---|---|---|
| 1 | $Na_2S_2O_3$ | 5.7 | .04/16 | 2.60 | 100 |
| 2 | Compound 4 | 5.3 | .00/.03 | 2.87 | 124 |

EXAMPLE 8

A silver iodobromide emulsion was made according to Procedure C and divided into two portions. One portion was digested according to Procedure G with gold chloride and sodium thiosulfate as the sensitizing combination. There was added to the second portion in place of the gold chloride and sodium thiosulfate, $1.74 \times 10^{-4}$ mole of Compound 1 per 1.5 moles of silver nitrate. All other operations were carried out as described in Example 5 to give the sensitometric data shown in the table below. It will be seen that gold is not necessary to obtain improved response with trithiocarbonate sensitizers.

Table VIII

| Ctg. No. | Additive | Test Age | Dmin | Dmax | Speed Dens. = 1.0 |
|---|---|---|---|---|---|
| 1 | Control | Fresh | .04 | 2.48 | 100 |
| | Gold & Thiosulfate | Oven | .04 | 2.94 | 125 |
| 2 | $1.74 \times 10^{-4}$ mole | Fresh | .04 | 5.62 | 1160 |
| | Compd. 1/1.5 $AgNO_3$ | Oven | .04 | 5.06 | 780 |

The data clearly indicate that the trithiocarbonates are effective chemical sensitizers for silver halide emulsions and do not cause a detrimental effect on the stabilization of the system, i.e., fog on tropical aging, etc.

As indicated by the various examples, the trithiocarbonate compounds of this invention may be used as the sole sensitizer in silver halide emulsion systems or they may be used in conjunction with other known sensitizers e.g., sulfur and noble metal compounds, and optical sensitizers. There also may be used reducing agents, e.g., stannous salts, compounds which sensitize by development acceleration, e.g., polyoxyethylene compounds and polyhedral boranes.

I claim:

1. A photographic element comprising a support bearing at least one layer of a photographic silver halide emulsion which is chemically sensitized by the addition thereto prior to or during digestion of at least one trithiocarbonate of the general formula:

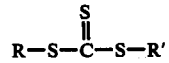

wherein R is a tertiary alkyl radical having from 4 to 16 carbon atoms, and wherein R' is R or an aryl or an alphyl radical containing 1 to 3 phenyl groups.

2. The composition of claim 1 wherein the trithiocarbonate is tert.-butyl triphenyl methyl-trithiocarbonate

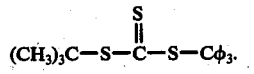

3. The composition of claim 1 wherein the trithiocarbonate is di-tert.-butyl trithiocarbonate

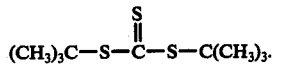

4. The composition of claim 1 wherein the trithiocarbonate is 1,1-dimethyl propyl triphenyl methyl trithiocarbonate

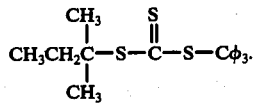

5. The composition of claim 1 wherein the trithiocarbonate is tert.-butyl diphenyl methyl trithiocarbonate.

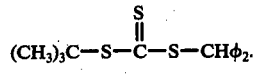

6. The composition of claim 1 wherein the trithiocarbonate is tert.-butyl phenol methyl trithiocarbonate

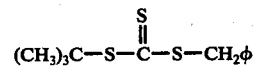

7. The composition of claim 1 wherein the trithiocarbonate is tert.-butyl phenyl trithiocarbonate

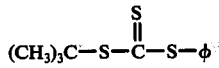

* * * * *